US010648471B2

(12) United States Patent
Kim et al.

(10) Patent No.: US 10,648,471 B2
(45) Date of Patent: May 12, 2020

(54) SCROLL COMPRESSOR

(71) Applicant: LG ELECTRONICS INC., Seoul (KR)

(72) Inventors: Taekyoung Kim, Seoul (KR); Kangwook Lee, Seoul (KR); Cheolhwan Kim, Seoul (KR); Byeongchul Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 34 days.

(21) Appl. No.: 15/448,955

(22) Filed: Mar. 3, 2017

(65) Prior Publication Data

US 2017/0306964 A1 Oct. 26, 2017

(30) Foreign Application Priority Data

Apr. 26, 2016 (KR) ..... 10-2016-0051045

(51) Int. Cl.
*F04C 29/02* (2006.01)
*F04C 23/00* (2006.01)
(Continued)

(52) U.S. Cl.
CPC ..... *F04C 29/026* (2013.01); *F04C 18/0215* (2013.01); *F04C 23/008* (2013.01);
(Continued)

(58) Field of Classification Search
CPC ..... F04C 18/0215–0223; F04C 29/02–028; F04C 29/12; F04C 23/008; F04C 29/0085; F04C 2240/40; F04C 2240/603
(Continued)

(56) References Cited

U.S. PATENT DOCUMENTS 4,768,936 A 9/1988 Etemad et al.
5,040,952 A * 8/1991 Inoue ..... F04C 18/0215 417/312
(Continued)

FOREIGN PATENT DOCUMENTS

CN 1184895 6/1998
CN 1782632 6/2006
(Continued)

OTHER PUBLICATIONS

Chinese Office Action dated Apr. 30, 2019 with English Translation.
(Continued)

*Primary Examiner* — Alexander B Comley
(74) *Attorney, Agent, or Firm* — Ked & Associates, LLP

(57) ABSTRACT

A scroll compressor is provided that may include a casing that contains oil in a lower space thereof; a drive motor provided at a position spaced from an upper end of the casing by a predetermined gap, such that an upper space is formed in the casing; a rotational shaft coupled to a rotor of the drive motor, and having an oil supply passage to guide the oil contained in the casing to an upper side of the drive motor; a frame provided below the drive motor; a fixed scroll provided below the frame, and having a fixed wrap; an orbiting scroll provided between the frame and the fixed scroll, having an orbiting wrap so as to form a compression chamber by being engaged with the fixed wrap, and a rotational shaft coupling portion to couple the rotational shaft to the orbiting scroll in a penetrating manner; and an oil collection unit including an oil separator provided at the upper space of the casing, and an oil guide having a first end that communicates with the oil separator and a second end that communicates with a lower space of the fixed scroll.

14 Claims, 10 Drawing Sheets

(51) Int. Cl.

| | |
|---|---|
| ***F04C 18/02*** | (2006.01) |
| ***F04C 29/00*** | (2006.01) |
| ***F04C 29/12*** | (2006.01) |

(52) U.S. Cl.
CPC ..... *F04C 29/0085* (2013.01); *F04C 29/023* (2013.01); *F04C 29/12* (2013.01); *F04C 2210/22* (2013.01); *F04C 2240/30* (2013.01); *F04C 2240/40* (2013.01); *F04C 2240/603* (2013.01)

(58) Field of Classification Search
USPC ..... 417/410.5; 418/55.6
See application file for complete search history.

(56) References Cited

U.S. PATENT DOCUMENTS

| | | | |
|---|---|---|---|
| 5,421,708 | A | 6/1995 | Utter |
| 2008/0170957 | A1 | 7/2008 | Hwang et al. |
| 2016/0040672 | A1 | 2/2016 | Lee |

FOREIGN PATENT DOCUMENTS

| | | | | |
|---|---|---|---|---|
| CN | 101358597 | | | 2/2009 |
| CN | 101358597 | A | * | 2/2009 |
| CN | 103459851 | | | 12/2013 |
| CN | 105370576 | | | 3/2016 |
| JP | 57-18491 | | | 1/1982 |
| JP | 57-69991 | | | 4/1982 |
| JP | 57-83681 | | | 5/1982 |
| JP | 02-227587 | | | 9/1990 |
| JP | 05-1683 | | | 1/1993 |
| JP | 05-302581 | | | 11/1993 |
| JP | 08-303377 | | | 11/1996 |
| JP | 2012-211548 | | | 11/2012 |
| KR | 1020070072146 | | | 7/2007 |
| KR | 20080067262 | A | * | 7/2008 |
| KR | 10-1130465 | | | 3/2012 |
| KR | 101130465 | B1 | * | 3/2012 |
| KR | 10-2012-0109088 | | | 10/2012 |
| KR | 10-2016-0017993 | | | 2/2016 |

OTHER PUBLICATIONS

European Search Report dated Aug. 28, 2019.
International Search Report dated Apr. 18, 2017 issued in Application No. PCT/KR2017/000277.

* cited by examiner

SCROLL COMPRESSOR

CROSS-REFERENCE TO RELATED APPLICATION(S)

Pursuant to 35 U.S.C. § 119(a), this application claims the benefit of an earlier filing date of and the right of priority to Korean Application No. 10-2016-0051045, filed in Korea on Apr. 26, 2016, the contents of which are incorporated by reference herein in its entirety.

BACKGROUND

1. Field

A scroll compressor, and more particularly, a scroll compressor having a compression device disposed below a motor is disclosed herein.

2. Background

Generally, a compressor is applied to a vapor-compression type refrigerating cycle, such as a refrigerator or an air conditioner (hereinafter, referred to as a "refrigerating cycle"). The compressor may be categorized into a hermetic compressor where a motor part and a compression part operated by the motor part are installed at a hermetic inner space of a casing, and an open compressor where the motor part is installed outside of the casing. Refrigerating devices for a home or company mainly use the hermetic compressor.

The compressor may be categorized into a reciprocating compressor, a rotary compressor, a scroll compressor, for example, according to a refrigerant compression method. The reciprocating compressor compresses a refrigerant by linearly moving a piston by a piston drive unit, and the rotary compressor compresses a refrigerant by using a rolling piston, which performs an eccentric rotational operation at a compression space of a cylinder, and by using a vane, which divides the compression space of the cylinder into a suction chamber and a discharge chamber by contacting the rolling piston. The scroll compressor consecutively compresses a refrigerant by forming a pair of compression chambers (a suction chamber, an intermediate pressure chamber, and a discharge chamber) between a fixed scroll and an orbiting scroll.

The compressor may be categorized into an upper compression type compressor and a lower compression type compressor according to a position of a motor part and a compression part. The upper compression type compressor means a compressor where a compression part is positioned above a motor part, whereas the lower compression type compressor means a compressor where a compression part is positioned below a motor part. In a case of the lower compression type compressor, a refrigerant discharged to an inner space of a casing moves to a discharge pipe disposed at an upper part of the casing. In this case, oil is collected in an oil storage space provided below the compression part. The oil may be discharged to the outside of the compressor in a mixed state with a refrigerant, or may remain above the motor part by a pressure of a refrigerant.

FIG. 1 is a longitudinal sectional view illustrating an example of a lower compression type scroll compressor in accordance with the conventional art. As shown, the conventional lower compression type scroll compressor includes a casing 1 having an inner space 1*a*; a motor part 2 provided at the inner space 1*a* of the casing 1, and having a stator and a rotor of a drive motor; a compression part 3 provided below the motor part 2; and a rotational shaft 5 configured to transmit a rotational force of the motor part 2 to the compression part 3.

A refrigerant suction pipe 15 that communicates with the compression part 3 is connected to a lower part of the casing 1. A refrigerant discharge pipe 16, configured to discharge a refrigerant discharged to the inner space 1*a* of the casing 1 to a refrigerating cycle, is connected to an upper part of the casing 1.

The inner space 1*a* of the casing 1 may be divided into a first space (S1) between the motor part 2 and the compression part 3, a second space (S2) formed above the motor part 2 that communicates with the first space (S1), and a third space (S3) formed below the compression part 3, that communicates with the second space (S2), and forms an oil storage space.

The first space (S1) and the second space (S2) communicate with each other by a space between an inner circumferential surface of a stator 21 and an outer circumferential surface of a rotor 22, and by a passage (P1) formed at an inner side of slots 212*b* of the rotor 22. The second space (S2) and the third space (S3) communicate with each other by a passage (P2) formed between an inner circumferential surface of the casing 1 and an outer circumferential surface of the motor part 2, and by a third passage (P3) formed between the inner circumferential surface of the casing 1 and an outer circumferential surface of the compression part 3.

The compression part 3 includes a main frame 31 positioned below the stator 21, and fixed to an inner circumferential surface of the casing 1; a non-orbiting scroll 32 coupled to a lower side of the main frame 31 (hereinafter, referred to as a "fixed scroll"); and an orbiting scroll 33 disposed between the main frame 31 and the fixed scroll 32, and coupled to an eccentric portion 53 of the rotational shaft 5 to perform an orbiting motion, and forming a pair of compression chambers (V) between the orbiting scroll 33 and the fixed scroll 32.

Unexplained reference numerals 5*a* denotes an oil supply passage, 7 denotes a balance weight, 11 denotes a cylindrical shell, 12 denotes an upper cap, 13 denotes a lower cap, 34 denotes a discharge cover, 35 denotes an Oldham's ring, 326 denotes a fixed wrap, 333 denotes a rotational shaft coupling portion, and 336 denotes an orbiting wrap.

In the conventional lower compression type scroll compressor, a refrigerant and oil, discharged to the first space (S1) from the compression part 3, moves to the second space (S2) provided above the motor part 2 along the first passage (P1) provided at the motor part 2. Then, the refrigerant has the oil separated therefrom at the second space (S2), and then is discharged to the outside through the refrigerant discharge pipe 16. On the other hand, the oil is collected in the third space (S3) provided below the casing 1 along the second passage (P2) and the third passage (P3).

However, in the conventional lower compression type scroll compressor, oil separated at the second space (S2) should move to the third space (S3) along the second passage (P2) formed between the inner circumferential surface of the casing 1 and the outer circumferential surface of the stator 21. In this case, a large amount of oil may not be collected in an oil storage space due to a narrow area of the second passage (P2), but may remain at the second space (S2). As a result, a small amount of oil is stored at the oil storage space, and thus oil is not sufficiently supplied to the compression part 3. This may cause a frictional loss or abrasion at the compression part.

Further, in the conventional lower compression type scroll compressor, oil which remains at the second space (S2) is mixed with a refrigerant discharged from the compression part 3, and then is discharged to the outside of the compressor. This may increase oil deficiency in the compressor.

Furthermore, in the conventional lower compression type scroll compressor, oil separated at the second space (S2) flows down only by its weight to be collected in the oil storage space. Accordingly, when the second passage (P2) has a narrow area, oil may not smoothly pass through the second passage (P2). This may reduce the amount of oil to be collected.

Further, in the conventional lower compression type scroll compressor, the second passage (P2) at the motor part 2 is formed in the same direction as a coupling direction of the refrigerant discharge pipe 16. As a result, a refrigerant introduced into the second space (S2) via the motor part 2 is rapidly discharged to the refrigerant discharge pipe 16. This may cause oil not to be effectively separated from a refrigerant.

BRIEF DESCRIPTION OF THE DRAWINGS

Embodiments will be described in detail with reference to the following drawings in which like reference numerals refer to like elements, and wherein.

DETAILED DESCRIPTION

Figure 1:
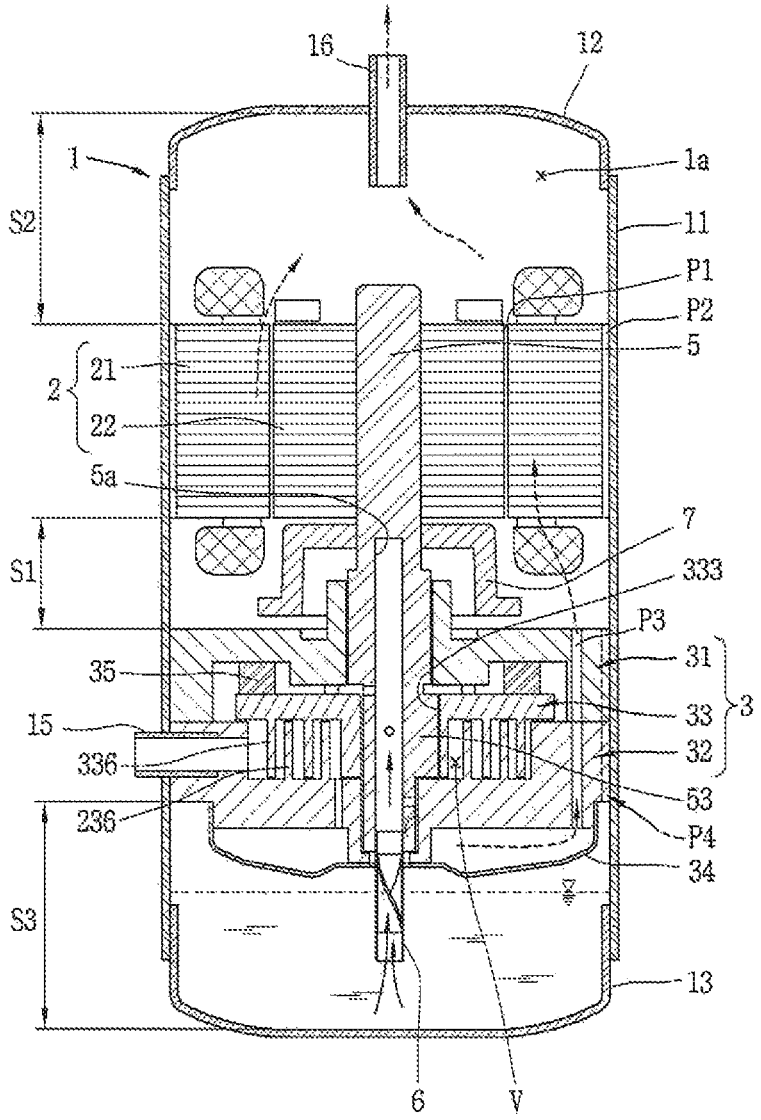
FIG. 1 CONVENTIONAL ART
FIG. 1 is a longitudinal sectional view illustrating an example of a lower compression type scroll compressor in accordance with the conventional art.

Hereinafter, a scroll compressor according to an embodiment will be explained in more detail with reference to the attached drawings. Where possible, like reference numerals have been used to indicate like elements, and repetitive disclosure has been omitted.

Figure 2:
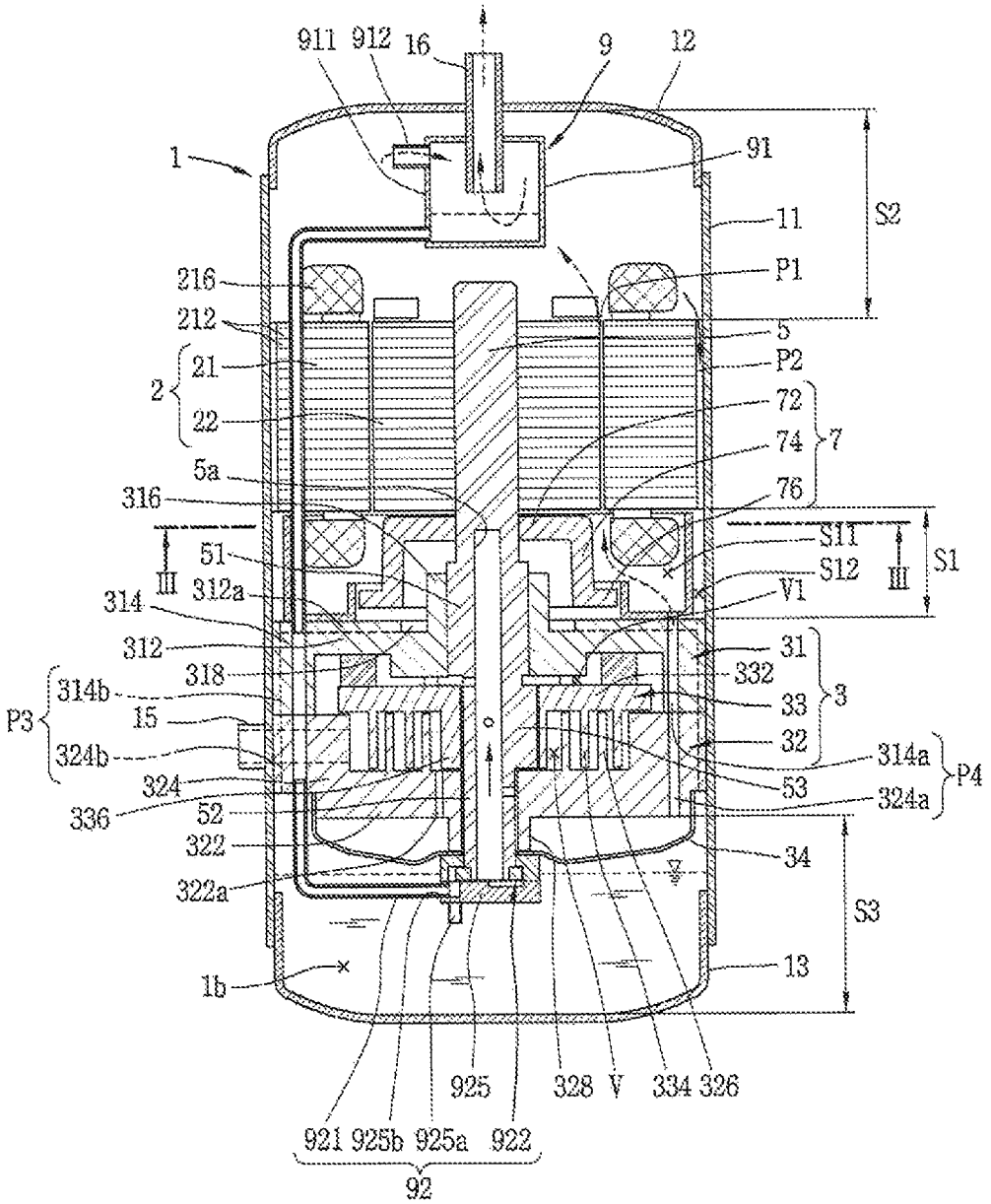
FIG. 2 is a longitudinal sectional view illustrating an example of a lower compression type scroll compressor according an embodiment.
Figure 3:
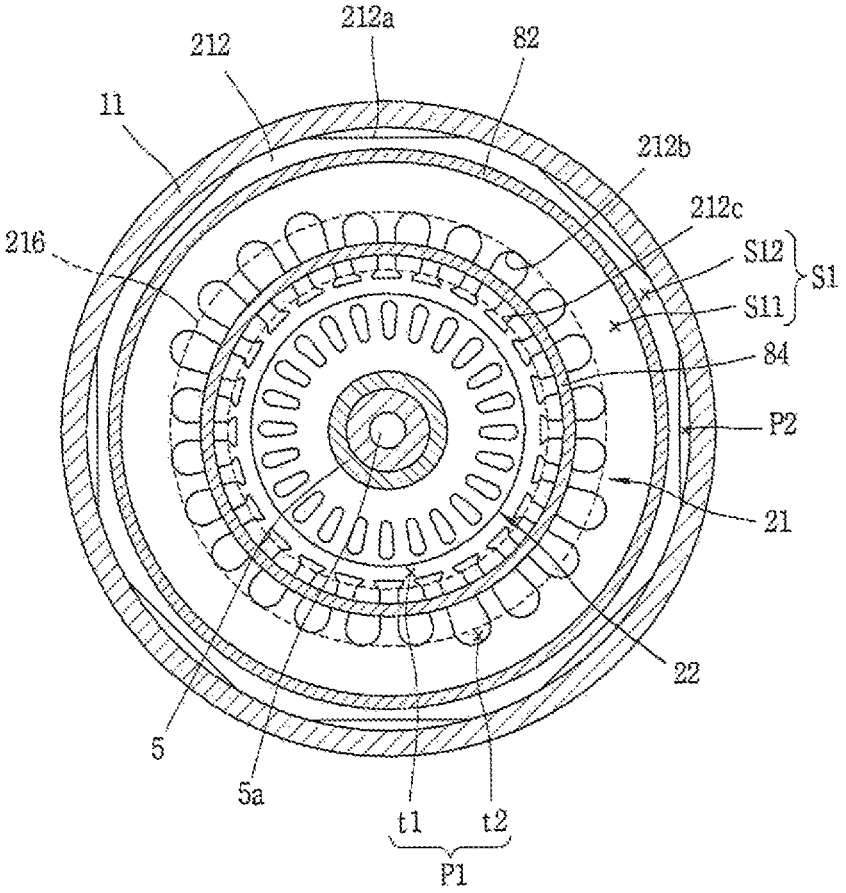
FIG. 3 is a sectional view taken along line III-III in FIG. 2.
Figure 4:
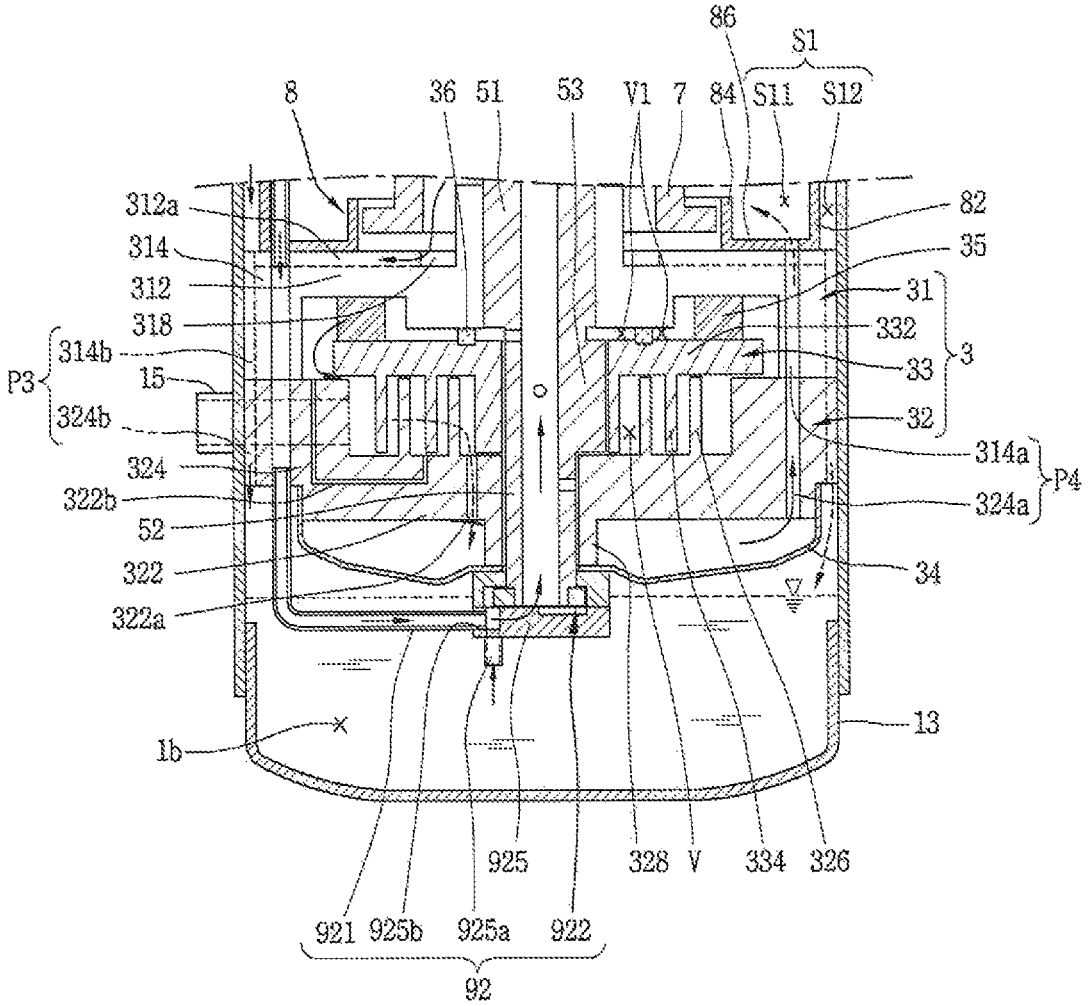
FIG. 4 is a longitudinal sectional view, which illustrates a compression part of FIG. 3 in an enlarged manner.

FIG. 2 is a longitudinal sectional view illustrating an example of a lower compression type scroll compressor according to an embodiment. FIG. 3 is a sectional view taken along line III-III in FIG. 2. FIG. 4 is a longitudinal sectional view, which illustrates a compression part of FIG. 3 in an enlarged manner.

As shown in FIGS. 2 to 4, a lower compression type scroll compressor according to this embodiment may include a casing 1 having an inner space; a motor part or motor 2 provided at an upper part or portion of the inner space of the casing 1, and which forms a drive motor, a compression part or device 3 disposed or provided below the motor part 2; a rotational shaft 5 that transmits a drive force to the compression part 3 from the motor part 2; and a flow path separator 8 installed or provided between the motor part 2 and the compression part 3, and configured to separate a refrigerant flow path and an oil flow path from each other. The inner space 1*a* of the casing 1 may be divided into a first space (S1) between the motor part 2 and the compression part 3, a second space (S2) that communicates with the first space (S1) and serves as an upper space of the motor part 2, and a third space (S3) that communicates with the second space (S2) and serves as a lower space of the compression part 3. Thus, the flow path separator 8 may be provided at or in the first space (S1).

The casing 1 may include a cylindrical shell 11, which forms a hermetic container; an upper shell 12, which forms the hermetic container together by covering an upper part or portion of the cylindrical shell 11; and a lower shell 13, which forms the hermetic container together by covering a lower part or portion of the cylindrical shell 11, and which forms an oil storage space 1*b*.

A refrigerant suction pipe 15 may be penetratingly-formed at a side surface of the cylindrical shell 11, thereby directly communicating with a suction chamber of the compression part 3. A refrigerant discharge pipe 16 that communicates with the inner space of the casing 1 may be installed or provided at an upper part or portion of the upper shell 12. The refrigerant discharge pipe 16 may be installed or provided to communicate with the inner space of the casing 1 in an axial direction.

A stator 21 which constitutes or forms the motor part 2 may be installed or provided at an upper part or portion of the casing 1, and a rotor 22 which constitutes or forms the motor part 2 together with the stator 21 and is rotated by a reciprocal operation with the stator 21 may be rotatably installed or provided in the stator 21. The stator 21 and the rotor 22 may be spaced from each other by a predetermined gap, such that a first passage (P1), which is discussed hereinafter, may be formed.

As shown in FIG. 3, the stator 21 may include a stator core 212 having a ring shape and formed as a plurality of sheets laminated on each other, and a coil 216 wound on the stator core 212. A cut-out surface 212*a*, having an angular form in a circumferential direction, may be formed on an outer circumferential surface of the stator core 212. A predetermined space may be formed between the outer circumferential surface of the stator core 212 (more precisely, the cut-out surface 212*a*) and an inner circumferential surface of the cylindrical shell 11, such that a second passage (P2) may be formed.

However, the second passage (P2) between the outer circumferential surface of the stator core 212 and the inner circumferential surface of the cylindrical shell 11 may be formed in another manner. For example, the second passage (P2) may be formed as the outer circumferential surface of the stator core 212 is formed in a circular shape and a groove (not shown) may be recessed from the outer circumferential surface of the stator core 212.

The stator 22 may be formed in an approximate cylindrical shape, and a predetermined gap (t1) may be provided between the stator 21 and the rotor 22 such that the first passage (P1) may be formed between an outer circumferential surface of the rotor 22 and an inner circumferential surface of the stator 21. A plurality of slots 212*b* for winding the coil 216 thereon may be formed on the inner circumferential surface of the stator 21. A gap (t2) may be formed between each slot 212*b* and the coil 216, and the gap (t2) forms the first passage (P1) together with the gap (t1) between the stator 21 and the rotor 22.

A main frame 31 which constitutes or forms the compression part 3 may be fixed to an inner circumferential surface of the casing 1, below the stator 21 with a predetermined gap therebetween. The main frame 31 may include a frame plate portion or frame plate (hereinafter, referred to as a "first plate portion" or "first plate") 312 having an approximate circular shape; a frame side wall portion or frame side wall 314 (hereinafter, referred to as a "first side wall portion" of "first side wall") that protrudes downwardly from an outer circumference of the first plate portion 312; and a frame shaft accommodating portion (hereinafter, referred to as a "first shaft accommodating portion") 316 provided at a central part or portion of the first plate portion 312, and configured to pass the rotational shaft 5 therethrough. An outer circumference of the first side wall portion 314 may contact an inner circumferential surface of the cylindrical shell 11, and a lower end of the first side wall portion 314 may contact an upper end of a fixed scroll side wall portion 324, which is discussed hereinafter.

The first side wall portion 314 may be provided with a frame communication hole (hereinafter, referred to as a "first communication hole") 314*a*, which passes through an inside of the first side wall portion 314 in the axial direction and which forms a refrigerant discharge passage. The first communication hole 314*a* may have an inlet that communicate with a fixed scroll communication hole 324*a*, which is discussed hereinafter, and may have an outlet communicate with the first space (S1).

A plurality of frame communication grooves 314*b* (hereinafter, referred to as "first communication grooves") may be formed on an outer circumferential surface of the first side wall portion 314 in a circumferential direction, the groove 314*b* concaved in the axial direction and forming an oil passage as two sides thereof in the axial direction are open. The first communication grooves 314*b* may have an inlet that communicates with the second space (S2) through the second passage (P2), and may have an outlet that communicates with an inlet of a fixed scroll communication groove (hereinafter, referred to as a "second communication groove") 324*b*, which is discussed hereinafter, and provided on an outer circumferential surface of the fixed scroll 32. A space may be formed between the second communication groove 324*b* and the cylindrical shell 11, such that oil may be guided to the third space (S3) therethrough.

A first shaft accommodating portion 316 may protrude from an upper surface of the first plate portion 312, toward the motor part 2. A first bearing portion, configured to support a main bearing portion or bearing 51 of the rotational shaft 5, which is discussed hereinafter, by passing the main bearing portion 51 therethrough, may be penetratingly-formed at the first shaft accommodating portion 316.

An oil pocket 318, configured to collect oil discharged from a space between the first shaft accommodating portion 316 and the rotational shaft 5, may be formed on an upper surface of the first plate portion 312. An oil collection passage 312*a*, configured to communicate the oil pocket 318 with the first communication groove 314*b*, may be formed at one side of the oil pocket 318. The oil pocket 318 may be concaved from an upper surface of the first plate portion 312, and may be formed in a ring shape along an outer circumferential surface of the first shaft accommodating portion 316.

The oil collection passage 312*a* may be formed on an upper surface of the first plate portion 312, in the form of a concaved groove. In this case, as the oil collection passage 312*a* may be exposed to a refrigerant by communicating with a space between a first partition wall portion or wall 82 and a second partition wall portion or wall 84, a cover may be provided between the space between the first partition wall portion 82 and the second partition wall portion 84 and the oil collection passage 312*a*.

The fixed scroll 32 may be coupled to a lower surface of the main frame 31. The fixed scroll 32 may include a fixed scroll plate portion or plate (hereinafter, referred to as a "second plate portion" or "second plate") 322 having an approximate circular shape; the fixed scroll side wall portion or wall (hereinafter, referred to as a "second side wall portion" or "second side wall") 324 that-protrudes from upwardly an outer circumference of the second plate portion 322; a fixed wrap 326 that protrudes from an upper surface of the second plate portion 322, and engaged with an orbiting wrap 334 of an orbiting scroll 33, which is discussed hereinafter, to form a compression chamber (V); and a fixed scroll shaft accommodating portion (hereinafter, referred to as "a second shaft accommodating portion") 328 formed at a central part or portion of a rear surface of the second plate portion 322, and configured to pass the rotational shaft 5 therethrough.

A discharge opening 322*a*, configured to guide a compressed refrigerant to an inner space of a discharge cover 34 from the compression chamber (V), may be formed at the second plate portion 322. A position of the discharge opening 322*a* may be arbitrarily set according to a required discharge pressure, for example.

As the discharge opening 322*a* is formed toward the lower shell 13, the discharge cover to accommodate a discharged refrigerant and guide the refrigerant to the fixed scroll communication groove 324*b*, which is discussed hereinafter, later may be coupled to a lower surface of the fixed scroll 32. The discharge cover 34 may be coupled to the lower surface of the fixed scroll 32 in a sealed state, such that a refrigerant discharge passage and the oil storage space 1*b* may be separated from each other.

The discharge cover 34 may be formed such that its inner space may accommodate the discharge opening 322*a* and accommodate an inlet of the fixed scroll communication groove 324*b*, which is discussed hereinafter. A through hole (not shown), configured to pass an oil feeder 6 therethrough, may be formed at the discharge cover 34, the oil feeder 6 coupled to a sub bearing portion or sub bearing 52 of the rotational shaft 5, which is discussed hereinafter, and immersed in the oil storage space 1*b* of the casing 1.

An outer circumference of the second side wall portion 324 may contact an inner circumferential surface of the cylindrical shell 11, and an upper end of the second side wall portion 324 may contact a lower end of the first side wall portion 314. The fixed scroll communication hole (hereinafter, referred to as a "second communication hole") 324*a*, configured to form a refrigerant passage together with the first communication hole 314*a* by passing through the inside of the second side wall portion 324 in the axial direction, may be provided at the second side wall portion 324. The second communication hole 324*a* may be formed to correspond to the first communication hole 314*a*. An inlet of the second communication hole 324*a* may communicate with the inner space of the discharge cover 34, and an outlet thereof may communicate with the inlet of the first communication hole 314*a*.

The second communication hole 324*a* may communicate the inner space of the discharge cover 34 with the first space (S1), so as to guide a refrigerant discharged to the inner space of the discharge cover 34 from the compression chamber (V), to the first space (S1), together with the first communication hole 314*a*. Hereinafter, a flow path by the second communication hole 324*a* and the first communication hole 314*a* may be defined or referred to as a discharge passage.

The second side wall portion 324 may be provided with the fixed scroll communication groove 324*b* concaved on an outer circumferential surface of the second side wall portion 324 in the axial direction and forming an oil passage as two sides thereof in the axial direction are open. The second communication groove 324*b* may be formed to correspond to the first communication groove 314*b* of the main frame 31. An inlet of the second communication groove 324*b* may communicate with an outlet of the first communication groove 314*b*, and an outlet thereof may communicate with the third space (S3) (oil storage space). The second communication groove 324*b* may form a space between the second side wall portion 324 and the cylindrical shell 11.

The second communication groove 324*b* may communicate the second space (S2) with the third space (83) together with the first communication groove 314*b*, such that oil may move from the second space (S2) to the third space (S3). Hereinafter, a flow path by the first communication groove 314*b* and the second communication groove 324*b* may be defined or referred to as a third passage (P3).

The refrigerant suction pipe 15 may be installed or provided at the second side wall portion 324 so as to communicate with a suction side of the compression chamber (V). The refrigerant suction pipe 15 may be spaced from the second communication hole 324*a*.

The second shaft accommodating portion 328 may protrude from a lower surface of the second plate portion 322, toward the third space (S3), that is, the oil storage space 1*b*. A second bearing portion, configured to insertion-support a sub bearing portion 52 of the rotational shaft 5, which is discussed hereinafter, may be provided at the second shaft accommodating portion 328.

The orbiting scroll 33, which performs an orbiting motion in a coupled state to the rotational shaft 5, and which forms a pair of compression chambers (V) between itself and the fixed scroll 32, may be installed or provided between the main frame 31 and the fixed scroll 32. The orbiting scroll 33 may include an orbiting scroll plate portion or plate having an approximate circular shape (hereinafter, referred to as a "third plate portion" or "third plate") 332; the orbiting wrap 334 that protrudes from a lower surface of the third plate portion 332, and engaged with the fixed wrap 326; and a rotational shaft coupling portion 336 provided at a central part or portion of the third plate portion 332, and rotatably-coupled to an eccentric portion 53 of the rotational shaft 5, which is discussed hereinafter.

The orbiting scroll 33 may be supported by the fixed scroll 32, as an outer circumference of the third plate portion 332 is mounted to an upper end of the second side wall portion 324, and as a lower end of the orbiting wrap 334 contacts an upper surface of the second plate portion 322.

An outer circumference of the rotational shaft coupling portion 336 may be connected to the orbiting wrap 334, thereby forming the compression chambers (V) together with the fixed wrap 326 during a compression process. The fixed wrap 326 and the orbiting wrap 334 may have an involute shape; however, embodiments are not limited thereto and they may have various shapes.

The eccentric portion 53 of the rotational shaft 5, which is discussed hereinafter, may be inserted into the rotational shaft coupling portion 336, so as to be overlapped with the orbiting wrap 334 or the fixed wrap 326 in a radial direction of the scroll compressor. With such a configuration, a repulsive force of a refrigerant is applied to the fixed wrap 326 and the orbiting wrap 334 during a compression process, and a compressive force is applied to a space between the rotational shaft coupling portion 336 and the eccentric portion 53 as a reaction force. In a case where the eccentric portion 53 of the rotational shaft 5 is overlapped with the orbiting wrap 334 in the radial direction by passing through the orbiting scroll plate portion 332, a repulsive force and a compressive force of a refrigerant are applied to a same plane on the basis of the third plate portion 332 to be attenuated by each other. This may prevent a tilted state of the orbiting scroll 33 due to the compressive force and the repulsive force.

The rotational shaft 5 may be supported in the radial direction as an upper part or portion thereof is forcibly-inserted into a central region of the 22, and as a lower part or portion thereof is coupled to the compression part 3.

The main bearing portion 51, supported in the radial direction in an inserted state into the first shaft accommodating portion 316, may be formed at the lower part of the rotational shaft 5. The sub bearing portion 52, supported in the radial direction in an inserted state into the second shaft accommodating portion 328, may be formed below the main bearing portion 51. The eccentric portion 53 may be formed between the main bearing portion 51 and the sub bearing portion 52, so as to be inserted into the rotational shaft coupling portion 336 of the orbiting scroll 33.

The main bearing portion 51 and the sub bearing portion 52 may be formed to be concentric with each other, and the eccentric portion 53 may be formed to be eccentric from the main bearing portion 51 or the sub bearing portion 52 in the radial direction. The sub bearing portion 52 may be formed to be eccentric from the main bearing portion 51.

An outer diameter of the eccentric portion 53 may be formed to be smaller than the main bearing portion 51 but larger than the sub bearing portion 52, such that the rotational shaft 5 may be easily coupled to the eccentric portion 53 through the first and second shaft accommodating portions 316, 328 and the rotational shaft coupling portion 336. However, in a case of forming the eccentric portion 53 using an additional bearing without integrally forming the eccentric portion 53 with the rotational shaft 5, the rotational shaft 5 may be coupled to the eccentric portion 53, without the configuration that the outer diameter of the eccentric portion 53 is larger than the sub bearing portion 52.

An oil supply passage 5*a*, along which oil may be supplied to the bearing portions 51, 52 and the eccentric portion 53, may be formed in the rotational shaft 5. As the compression part 3 is disposed or provided below the motor part 2, the oil supply passage 5*a* may be formed in a chamfering manner from a lower end of the rotational shaft 5 to a lower end of the stator 21 or to an intermediate height of the stator 21 approximately, or to a height higher than an upper end of the main bearing portion 51.

A balance weight 7 configured to restrain or prevent noise and vibrations may be coupled to the rotor 22 or the rotational shaft 5. The balance weight 7 may be provided between the motor part 2 and the compression part 3, that is, the first space (S1). The balance weight 7 may include a coupling portion 72 coupled to a lower surface of the rotor 22 or an outer circumferential surface of the rotational shaft 5; an extension portion 74 extended from the coupling portion 72 toward a lower side of the rotor 22; and a bending portion 76 bent from the extension portion 74, and protruded in the radial direction of the rotational shaft 5. In this embodiment, the end of the bending portion 76 may be a part farthest from a rotational center of the balance weight 7.

The flow path separator 8 may include the first partition wall portion or wall 82 that protrudes from the first space (S1) in the axial direction, and configured to partition the first space (S1) into a refrigerant space (S11) and an oil space (S12); the second partition wall portion or wall 84 disposed or provided between the rotational shaft 5 and the first partition wall portion 82; and a connection portion 86 formed to connect the first and second partition wall portions 82, 84.

The first partition wall portion 82 may be formed in an approximate ring shape. One or a first end of the first partition wall portion 82 may be positioned between an inlet of the first passage (P1) and an outlet of the second passage (P2), and another or second end thereof may be positioned between an inlet of the third passage (P3) and an outlet of a fourth passage (P4). With such a configuration, the second passage (P2) formed between the inner circumferential surface of the cylindrical shell 11 and the outer circumferential surface of the stator 21, may be separated from the first passage (P1) formed between slots 212*b* of the stator 21 and a gap between the stator 21 and the rotor 22. The second passage (P2) may communicate with the third passage (P3) formed between the inner circumferential surface of the cylindrical shell 11 and the outer circumferential surface of the compression part 3. The first passage (P1) may communicate with the fourth passage (P4) formed between a discharge side of the compression part 3 and the first space (S1) and forming a discharge passage (P4).

Two ends of the first partition wall portion 82 may come in contact with the main frame 31 and the stator 21, respectively. However, considering damage during an assembly process, one end of the first partition wall portion 82 may be spaced from another member by an assembly tolerance, for minimization of refrigerant leakage.

The second partition wall portion 84 may be installed or provided between an inlet of the first passage (P1) and the rotational shaft 5, or between an outlet of the discharge passage (P4) and the balance weight 7, such that a mixture of refrigerant and oil at been the first space (S1) due to rotation of the rotational shaft 5 and the balance weight 7 may be restricted or prevented.

The second partition wall portion 84 may be formed in a ring shape having a smaller radius than the first partition wall portion 82. One or a first end of the second partition wall portion 84 may be disposed or provided between an outlet of the discharge passage (P4) and the rotational shaft 5 or the balance weight 7, and another or a second end thereof may be disposed or provided between a gap between the stator 21 and the rotor 22 and a bottom surface of the slot 212*b*.

The second partition wall portion 84 may be provided such that one or a first end thereof may contact the main frame 31 like the first partition wall portion 82, and another or a second end thereof may be spaced from the stator 21. With such a configuration, damage to the second partition wall portion 84 at a space between the stator 21 and the main frame 31 during an assembly process may be prevented. Further, as an area of the first passage (P1) is widened, a refrigerant may be smoothly moved to the second space (S2) from the first space (S1).

The connection portion 86 may be formed to connect the first and second partition wall portions 82, 84, thereby integrally modularizing the first and second partition wall portions 82, 84. This may facilitate fabrication of the scroll compressor, and may reduce fabrication costs.

An unexplained reference numeral 35 denotes an Oldham's ring for preventing a rotation of the orbiting scroll, and 36 denotes a sealing member. A reference numeral 322*b* denotes a back pressure hole, and V1 denotes a back pressure chamber formed inside the Oldham's ring.

Hereinafter, an operation of the lower compression type scroll compressor according to this embodiment will be explained.

Firstly, once power is supplied to the motor part 2, the rotor 21 and the rotational shaft 5 may be rotated as a rotational force is generated. As the rotational shaft 5 is rotated, the orbiting scroll 33 eccentrically-coupled to the rotational shaft 5 performs an orbiting motion by the Oldham's ring 35.

As a result, a refrigerant supplied from outside of the casing 1 through the refrigerant suction pipe 15 may be introduced into the compression chambers (V), and the refrigerant may be compressed as a volume of the compression chambers (V) is reduced by the orbiting motion of the orbiting scroll 33. Then, the compressed refrigerant may be discharged to an inner space of the discharge cover 34 through the discharge opening 322*a*.

Then, the refrigerant discharged to the inner space of the discharge cover 34 may circulate at the inner space of the discharge cover 34, thereby having its noise reduced. Then, the refrigerant may move to the first space (S1) along the discharge passage (P4).

The refrigerant which has moved to the first space (S1) may not be moved to the oil space (812) by the flow path separator 8, but rather, may be guided to the first passage (P1) formed between slots 212*b* of the stator 21 and a gap between the stator 21 and the rotor 22 at the refrigerant space (S11), thereby moving to the second space (S2). The refrigerant which has moved to the second space (S2) may move toward the refrigerant discharge pipe 16 at the second space (S2), and have oil separated therefrom. The oil-separated refrigerant may be discharged to the outside of the scroll compressor through the refrigerant discharge pipe 16. On the other hand, the oil separated from the refrigerant may move to the oil space (S12) of the first space (S1), along the second passage (P2). The oil which has moved to the oil space (S12) may not be moved to the refrigerant space (S11) by the first partition wall portion 82 of the flow path separator 8, but rather, may be guided to an inlet of the third passage (P3). Then, the oil may be collected in the oil storage space of the third space (S3). These processes may be repeatedly performed.

Oil supplied to a sliding surface may perform a lubrication operation, and may be discharged to the first space (1S) between the first shaft accommodating portion 316 and the rotational shaft 5. The oil may be collected in the oil pocket 318, and then may be collected in the oil storage space of the third space (S3) along the oil collection passage 312*a* and the third passage (P3).

As aforementioned, in the scroll compressor according to this embodiment, as the flow path separator 8 is provided between the motor part 2 and the compression part 3, a refrigerant passage and an oil passage may be separated from each other. As a result, oil discharged from the compression part together with a refrigerant may pass through the motor part, and then be separated from a refrigerant at the second space, an upper space of the motor part. Then, the oil may be collected in the oil storage space along the oil passage.

The second passage (P2) may be formed as a plurality of spaces having a predetermined area between a plurality of cut-out surfaces 212*a* and the inner circumferential surface of the cylindrical shell 11 contacting the cut-out surfaces 212*a*. The cut-out portions 212*a* may be formed on the outer circumferential surface of the stator 21 with a predetermined gap therebetween. As the second passage (P2) has a small area, oil separated from a refrigerant at the second space (P2) may not be smoothly discharged to the oil storage space along the second passage (P2), but may remain.

In order to solve such a problem, each of the plurality of spaces which constitute or form the second passage (P2) should have a wide area. In this case, an area of a magnetic path may be reduced, and performance of a motor with respect to the same diameter may be lowered.

Alternatively, instead of reducing the number of the cut-out surfaces 212*a* which constitute or form the second passage (P2), an area of each of the cut-out surfaces 212*a* may be increased. However, in this case, it is not easy to increase an area of the cut-out surface 212*a* when considering a position of the slots 212*b* of the stator 21, and an interval between the cut-out surfaces 212*a* may be widened to cause oil to remain in the interval. Further, due to a non-uniform area of a magnetic path, performance of a motor with respect to a same diameter may be lowered.

Accordingly, an oil collection unit capable of smoothly collecting oil separated from a refrigerant to the oil storage space, the third space (S3) may be further provided, without lowering performance of a motor with respect to the same diameter.

Figure 5:
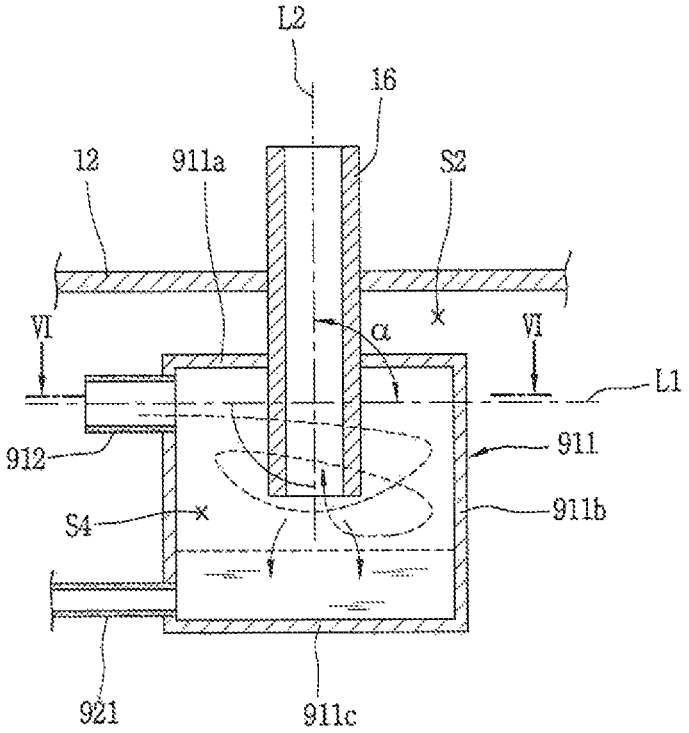
FIG. 5 is a longitudinal sectional view, which illustrates an oil separator in the lower compression type scroll compressor of FIG. 2.
Figure 6:
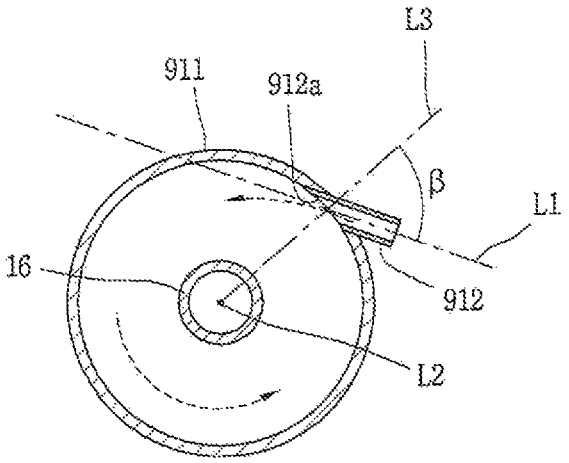
FIG. 6 is a sectional view taken along line VI-VI in FIG. 5.

FIG. 5 is a longitudinal sectional view, which illustrates an oil separator in the lower compression type scroll compressor of FIG. 2. FIG. 6 is a sectional view taken along line VI-VI in FIG. 5.

Referring to FIGS. 2 and 4, an oil collection unit 9 according to this embodiment may include an oil separator 91 provided at the second space (S2) where a refrigerant and oil move in a mixed state, and an oil guiding portion or guide 92 connected to the oil separator 91 and configured to guide oil separated by the oil separator 91 to the third space (S3). As shown in FIGS. 5 and 6, the oil separator 91 may include an oil separation container 911 which forms a container having a predetermined oil separation space (S4) and with which one end of the oil guiding portion 92 communicates; and a communication pipe 912 provided at one side of the oil separation container 911, and configured to communicate the oil separation space (S4) with the upper space (S2).

The oil separation container 911 may be formed to have a volume smaller than a volume of the second space (S2), and the refrigerant discharge pipe 16 which penetrates the casing 1 may communicate with an upper surface 911*a* of the oil separation container 911. The communication pipe 912 and an oil collection pipe 921 of the oil guiding portion 92 may communicate with a side wall surface 911*b* of the oil separation container 911.

An end part or end 912*a* of the communication pipe 912, serving as an inlet, may be coupled to the side wall surface 911*b* of the oil separation container 911, that is, a position separated from the refrigerant discharge pipe 16 by a predetermined angle. For example, if the communication pipe 912 communicates with a bottom surface 911*c* of the oil separation container 911, a refrigerant introduced into the oil separation space (S4) through the communication pipe 912 may be discharged with oil through the refrigerant discharge pipe 16. This may lower an oil separation effect.

Further, if the communication pipe 912 communicates with an upper surface of the oil separation container 911, a refrigerant which has moved to the second space (S2) may be guided to the communication pipe 912 after circulating along a long moving path. This may enhance an oil separation effect at the second space (S2). However, as the refrigerant should move from an upper side to a lower side, a flow resistance may be increased. This may cause the refrigerant not to be smoothly discharged. Therefore, considering an oil separation effect and a flow resistance at the second space (S2), the communication pipe 912 may communicate with the side wall surface 911*b* such that a lengthwise center line (L1) at the end part 912*a* of the communication pipe 912 forms a predetermined angle ($\alpha$) with an axial center line (L2) of the refrigerant discharge pipe 16.

The communication pipe 912 may communicate with the oil separation container 911 in a normal line direction. However, in this case, an oil separation effect may be lowered. As shown in FIG. 6, for an enhanced oil separation effect, the communication pipe 912 may communicate with the oil separation container 911 such that the lengthwise center line (L1) at the end part 912*a* of the communication pipe 912 forms a predetermined angle ($\beta$) with a virtual line (L3) in a normal line direction towards an axial center of the oil separation container 911 (towards a center line of a rotational shaft center). The oil guiding portion 92 may include the oil collection pipe 921 configured to collect oil separated at the oil separation container 911 to the oil storage space (S3), and an oil pump 922 installed at an outlet of the oil collection pipe 921 and configured to forcibly pump oil.

Referring to FIGS. 2 and 4, one or a first end of the oil collection pipe 921 may be connected to the oil separation container 911, another or a second end thereof may be connected to an inlet of the oil pump 922 via the stator core 212 of the drive motor part 2, the first side wall portion 314 of the main frame 31, the second side wall portion 324 of the fixed scroll 32, and the discharge cover 34. The oil collection pipe 921 may be disposed or provided at a position lower than the communication pipe 912, for smooth collection of separated oil.

As the oil pump 922, various pumps may be used. A displacement pump for pumping oil using a rotational force of the rotational shaft 5, for example, a trochoid gear pump, may be used. In this case, a plurality of suction openings 925*a*, 925*b* may be provided at a pump housing 925. One or a first suction opening 925*a* may be open toward the oil storage space (S3), and another or a second suction opening 925*b* may be connected to the oil collection pipe 921.

In the lower compression type scroll compressor, a refrigerant which moves to the second space (S2) has oil primarily-separated therefrom while circulating at the second space (S2). Then, the oil-separated refrigerant may be introduced into the oil separation space (S4) of the oil separation container 911 through the communication pipe 912. The oil separated from the refrigerant at the second space (S2) may be collected in the third space (S3), the oil storage space of the casing 1, along the second passage (P2) and the third passage (P3).

A refrigerant, introduced into the oil separation space (S4) of the oil separation container 911, has oil secondarily-separated therefrom while circulating at the oil separation space (S4). Then, the oil-separated refrigerant may be discharged to the outside of the scroll compressor through the refrigerant discharge pipe 16. On the other hand, the separated oil may be collected in the oil storage space (S3) through the oil collection pipe 921. In this case, as the oil pump 922 installed or provided at a bottom surface of the discharge cover 34 forcibly pumps the oil separated at the oil separation container 911, the separated oil may be rapidly collected in the oil storage space.

With such a configuration, even if the second passage formed between the inner circumferential surface of the casing and the outer circumferential surface of the stator has a narrow sectional area, the amount of oil separated at the second space is not large. This may reduce the occurrence of a bottle neck phenomenon at the second passage, and may allow oil to be rapidly collected in the oil storage space.

Further, a refrigerant inside of the second space (S2) has oil secondarily-separated therefrom through the oil separation container 911, before being discharged through the refrigerant discharge pipe 16. Then, the separated oil may be forcibly collected by the oil collection pipe 921 and the oil pump 922. With such a configuration, deficiency of the amount of oil at the oil storage space may be prevented, and thus, frictional loss or abrasion of the scroll compressor may be prevented.

Another embodiment of the oil separator in the lower compression type scroll compressor will be explained hereinafter.

Figure 7:
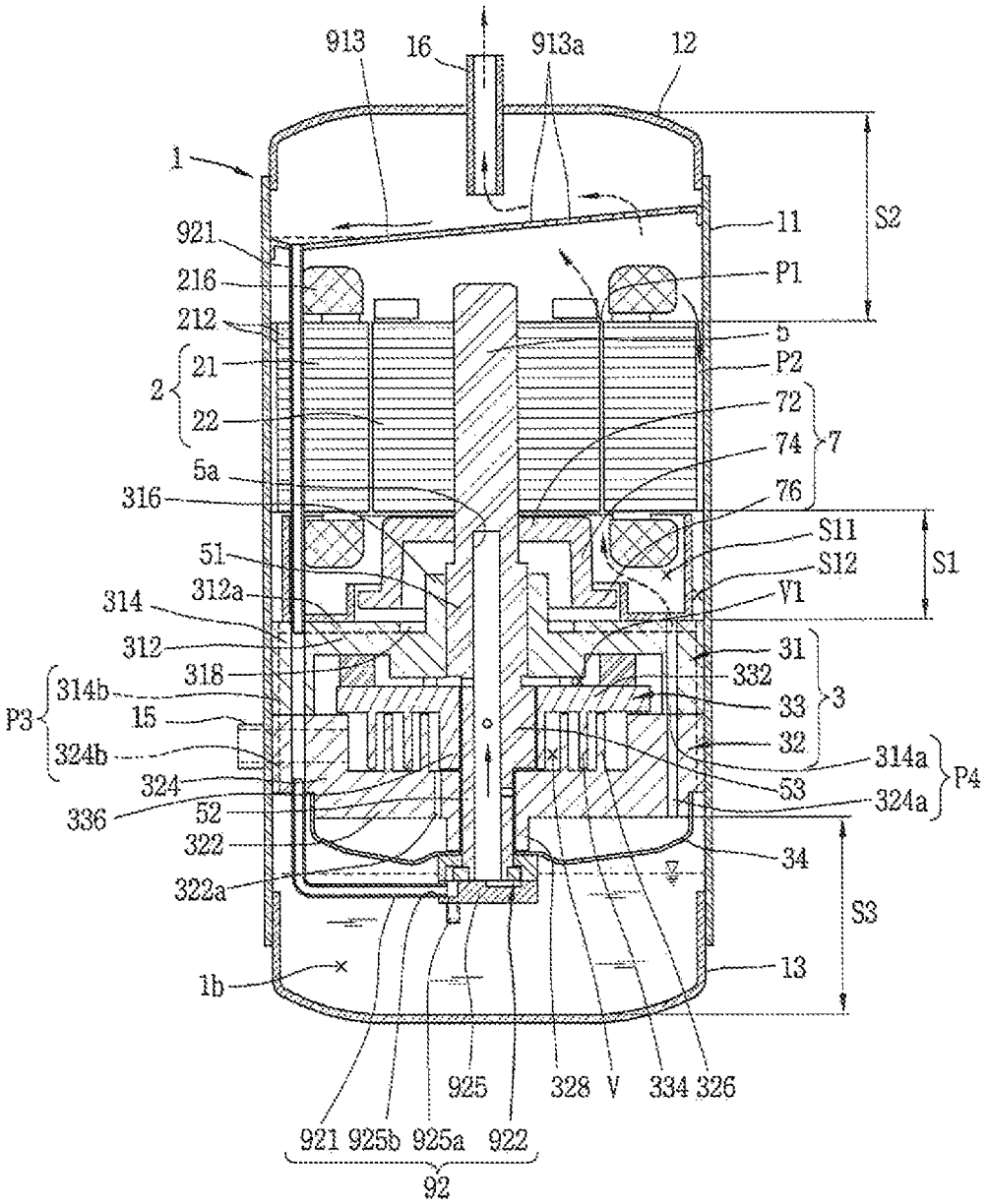
FIG. 7 is a longitudinal sectional view, which illustrates another embodiment of the oil separator in the lower compression type scroll compressor of FIG. 2.

That is, in the aforementioned embodiment, the oil separator is implemented as the oil separation container having a hermetic oil separation space. However, in this embodiment, as shown in FIG. 7, the oil separator is implemented as an oil separation plate 913 having a disc shape and installed or provided to divide the second space (S2) into two parts.

In this case, the oil separation plate 913 may be provided with a plurality of through holes 913*a* for communication between upper and lower sides of the second space (S2). One or a first end of the oil collection pipe 921 may be connected to a bottom surface of one of the through holes 913*a*.

The oil separation plate 913 may be formed to have a disc shape. However, for smooth guidance of separated oil into the oil collection pipe 921, the oil separation plate 913 may be formed to be inclined in a concaved manner on the basis of the oil collection pipe 921.

The oil separation unit including the oil separator according to this embodiment may have similar effects to the aforementioned ones. In this embodiment, the oil separator is more simplified than the aforementioned one to reduce fabrication costs.

Another embodiment of the oil guiding portion in the lower compression type scroll compressor will be explained hereinafter.

That is, in the aforementioned embodiment, the oil guiding portion is provided with an additional oil pump configured to collect oil separated by the oil separator. However, in this embodiment, oil separated by the oil separator is forcibly collected by a differential pressure without an additional oil pump.

Figure 8:
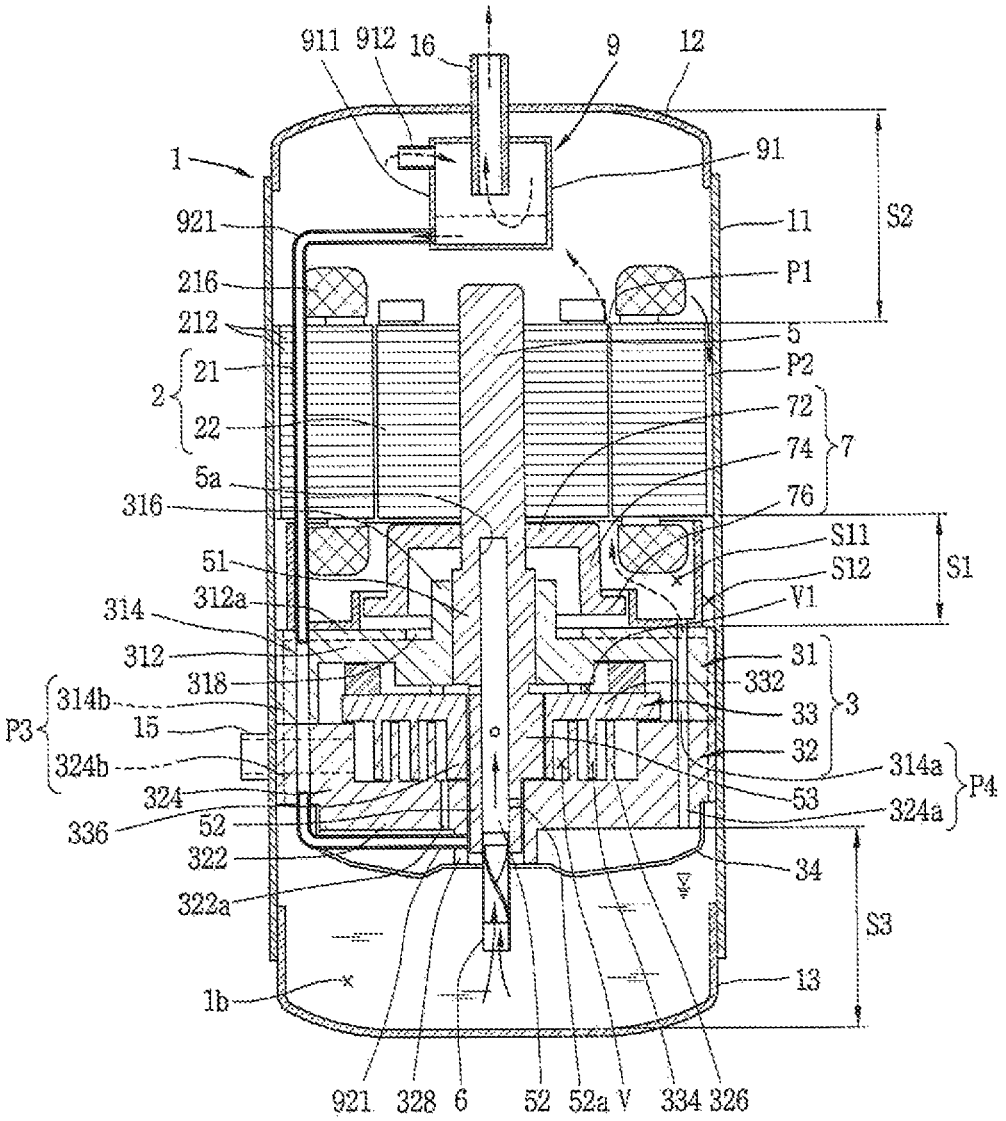
FIG. 8 is a longitudinal sectional view, which illustrates an oil guiding portion in the lower compression type scroll compressor of FIG. 2.

For example, as shown in FIG. 8, an oil passing hole 328*a* may be formed at the second shaft accommodating portion 328 of the fixed scroll 32, such that an outlet of the oil collection pipe 921 may communicate with a space between an outer circumferential surface of the rotational shaft 5 and an inner circumferential surface of the second shaft accommodating portion 328. With such a configuration, the oil collection pipe 921 may communicate with the oil supply passage 5*a* of the rotational shaft 5.

Figure 9:
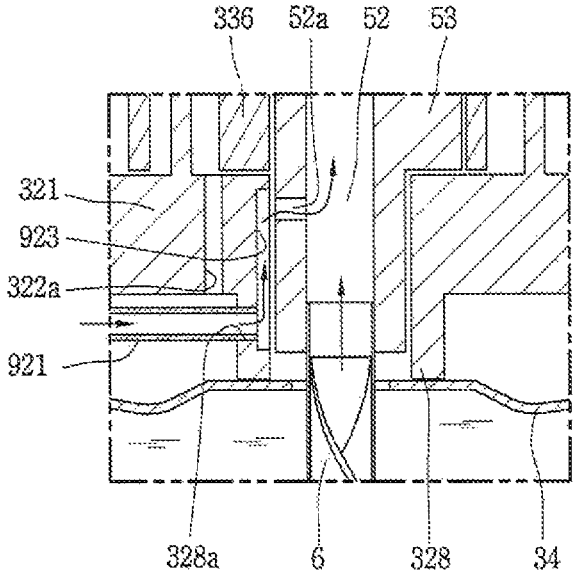
FIG. 9 is a longitudinal sectional view, which illustrates the oil guiding portion of FIG. 8 in an enlarged manner.

In this case, as shown in FIG. 9, an oil chamber 923 may be formed at the outlet of the oil collection pipe 921, that is, the inner circumferential surface of the second shaft accommodating portion 328, with an inner diameter equal to or larger than an inner diameter of an oil supply hole 52*a* provided at the sub bearing portion 52 of the rotational shaft 5, or equal to or larger than an inner diameter of the oil collection pipe (more precisely, the oil passing hole 328*a* provided at the second shaft accommodating portion of the fixed scroll). With such a configuration, oil collected in the oil collection pipe 921 may be contained in the oil chamber 923. This may allow the oil to be introduced into the oil supply passage 5*a* more smoothly.

Figure 10:
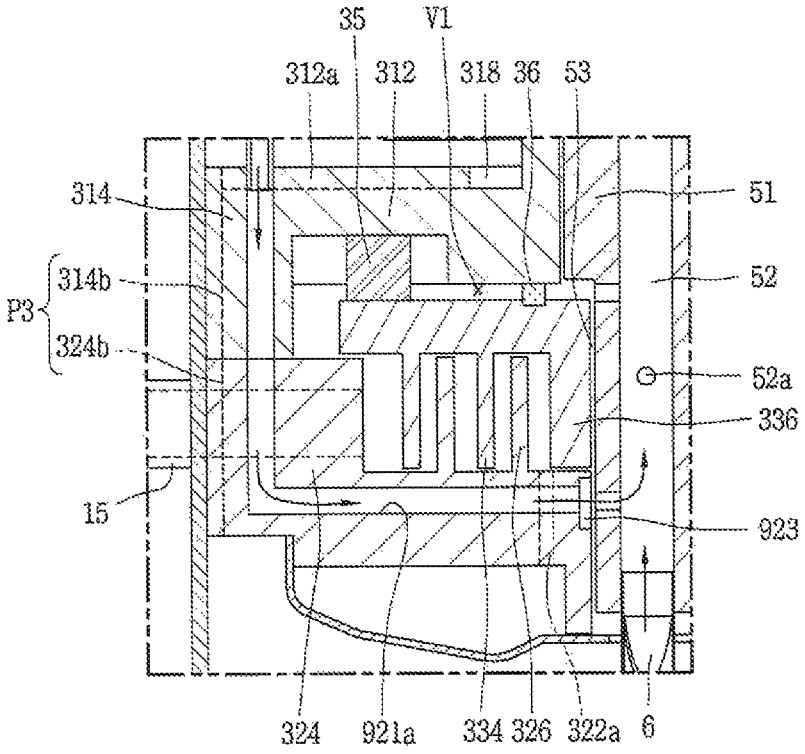
FIG. 10 is a longitudinal sectional view, which illustrates another embodiment of the oil guiding portion in the lower compression type scroll compressor of FIG. 2.

Further, similarly to the aforementioned embodiment, the oil collection pipe 921 may communicate with the oil pump 922 through the stator core 212 of the motor part 2, the first side wall portion 314 of the main frame 31, the second side wall portion 324 of the fixed scroll 32, and the discharge cover 34. However, as shown in FIG. 10, the oil collection pipe 921 may communicate with an oil collection passage 921*a* formed at the fixed scroll 32 so as to extend toward the inner circumferential surface of the second shaft accommodating portion 328.

In this case, the oil collection pipe 921 may be connected to the second shaft accommodating portion 328 of the fixed scroll 32, at a part or portion of the third passage (P3) formed at the main frame 31 and the fixed scroll 32. As shown in FIG. 10, the oil collection passage 921*a* may be formed at the main frame 31 and the fixed scroll 32, separately from the third passage (P3).

The oil collection unit according to this embodiment may have a similar configuration and effect to the aforementioned one. In this embodiment, the outlet of the oil collection unit 921 may communicate with a space between the outer circumferential surface of the rotational shaft 5 and the inner circumferential surface of the second shaft accommodating portion 328, the space having a lower pressure than the inside of the oil separation container 911. This may allow oil separated at the oil separation container to be rapidly moved to the oil supply passage of the rotational shaft, by a pressure difference.

That is, the inner space (S4) of the oil separation container 911 may have a discharge pressure or a pressure similar to the discharge pressure, whereas a back pressure chamber (V1) that communicates with the oil supply passage 5*a* of the rotational shaft 5 may have an intermediate pressure. Thus, once the inner space (S4) of the oil separation container 911 communicates with the oil supply passage 5*a* by the oil collection pipe 921, oil inside of the oil separation container 911 may move to the back pressure chamber (V1) via the oil collection pipe 921 and the oil supply passage 5*a*, by a pressure difference between the inside of the oil separation container 911 and the inside of the back pressure chamber (VI). Then, the oil which has moved to the back pressure chamber (V1) may slide over the Oldham's ring 35. Then, the oil may be introduced into the compression chambers (V) while lubricating a sliding surface between the fixed scroll 32 and the orbiting scroll 33, and then be discharged. These processes may be repeatedly performed.

The outlet of the oil collection pipe 921 may communicate with any region where a differential pressure may be generated, as well as the oil supply passage 5*a*. In this embodiment, oil may be collected by using a differential pressure without an oil pump. This may reduce the fabrication costs of the oil pump.

Still another embodiment of the oil guiding portion in the lower compression type scroll compressor will be explained hereinafter.

Figure 11:
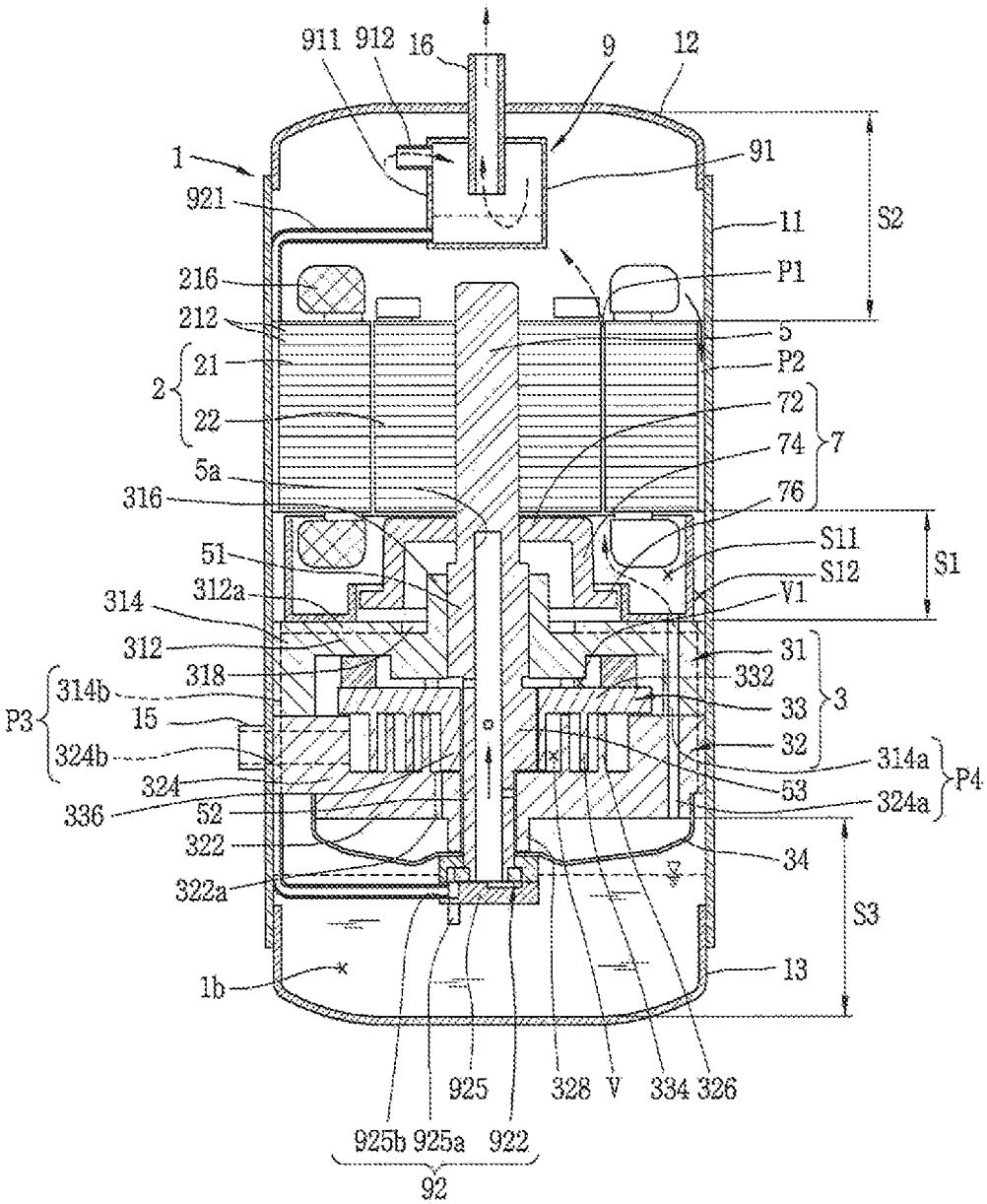
FIG. 11 is a longitudinal sectional view, which illustrates an oil collection pipe of the oil guiding portion in the lower compression type scroll compressor of FIG. 2.

In the aforementioned embodiments, the oil collection pipe communicates with the oil pump or the oil supply passage, through the motor part, the main frame, the fixed scroll, and the discharge cover. However, in this embodiment, as shown in FIG. 11, a first oil collection pipe 921*a* may be connected to one of cut-out surfaces 212*a* formed on an outer circumferential surface of the stator 21, that is, an inlet of the second passage (P2). A second oil collection pipe 924*b* may be connected to an outlet of the third passage (P3), that is, a lower end of the second communication groove 324*b* of the fixed scroll 32. In this case, a basic configuration and effects may be similar to the aforementioned ones, and thus, detailed explanations thereof have been omitted. In this embodiment, assembly processes may be facilitated and the fabrication costs may be reduced, as the oil collection pipe does not pass through the drive motor.

Embodiments disclosed herein provide a scroll compressor capable of smoothly collecting oil separated from a refrigerant to an oil storage space, by separating a refrigerant passage and an oil passage from each other in a casing. Embodiments disclosed herein further provide a scroll compressor capable of reducing an amount of oil discharged, by preventing oil separated from a refrigerant in a casing from being mixed with the refrigerant discharged from a compression part or device.

Embodiments disclosed herein provide a scroll compressor capable of forcibly collecting oil separated at a space of a motor part or motor to an oil storage space. Embodiments disclosed herein also provide a scroll compressor capable of effectively separating oil from a refrigerant at a space of a motor part.

Embodiments disclosed herein provide a scroll compressor that may include a casing having an inner space; a motor part or motor provided at the inner space, having a stator coupled to the casing, having a rotor rotatably provided in the stator, and having an oil collection passage between an outer circumferential surface of the stator and an inner circumferential surface of the casing; a compression part or device provided below the motor part, and having a discharge opening through which a refrigerant compressed thereat to the inner space of the casing may be discharged; a rotational shaft configured to transmit a drive force to the compression part from the motor part; and an oil guiding portion or guide configured to forcibly collect oil separated at an upper space of the motor part, using the rotational shaft. An oil separator may be installed at the upper space of the motor part, the oil separator being configured to separate oil from a refrigerant which moves to the upper space and to forcibly collect the separated oil by the oil guiding portion.

An oil pump may be provided at the compression part, such that oil collected by the oil guiding portion may be guided to an oil supply passage formed in the rotational shaft. Alternatively, an outlet of the oil guiding portion may be connected to a region having a lower pressure than the oil separator, such that oil collected by the oil guiding portion may be guided to an oil supply passage formed in the rotational shaft.

Embodiments disclosed herein provide a scroll compressor that may include a casing that contains oil at a lower space thereof; a drive motor provided at a position spaced from an upper end of the casing by a predetermined gap, such that an upper space is formed in the casing; a rotational shaft coupled to a rotor of the drive motor, and having an oil supply passage to guide the oil contained in the casing to an upper side; a frame provided below the drive motor; a fixed scroll provided below the frame, and having a fixed wrap; an orbiting scroll provided between the frame and the fixed scroll, having an orbiting wrap so as to form a compression chamber by being engaged with the fixed wrap, and having a rotational shaft coupling portion to couple the rotational shaft thereto in a penetrating manner; and an oil collection unit including an oil separator provided at the upper space of the casing and configured to separate oil from a refrigerant, and including an oil guiding portion or guide configured to guide the oil separated by the oil separator to the lower space of the casing. The oil separator may include an oil separation container having a predetermined oil separation space, and with which one end of the oil guiding portion may communicate, and a communication pipe provided at one side of the oil separation box, and configured to communicate the oil separation space with the upper space.

A lengthwise center line of the communication pipe at an end of the communication pipe may form a predetermined angle with the rotational shaft in an axial direction. One end of a refrigerant discharge pipe that penetrates the casing may communicate with the oil separation box, and a lengthwise center line of the refrigerant discharge pipe may form a predetermined angle with the lengthwise center line of the communication pipe.

The oil guiding portion may include an oil collection pipe having one or a first end connected to the oil separation box and an oil pump having an inlet to which another or a second end of the oil collection pipe is connected, and configured to pump oil separated at the oil separation box. The oil guiding portion may be formed as an oil collection pipe having one or a first end connected to the oil separation box, and another or a second end of the oil collection pipe may communicate with a region having a lower pressure than an inner pressure of the oil separation box.

An oil supply passage to guide oil contained in the casing may be formed at the rotational shaft, and a shaft accommodating portion to support the rotational shaft may be formed at the fixed scroll. An oil supply hole to guide oil suctioned through the oil supply passage to a bearing surface with the shaft accommodating portion may be formed at the rotational shaft. An oil passing hole may be formed at the shaft accommodating portion such that another end of the oil collection pipe may communicate with the oil passing hole. An oil chamber that communicates with the oil passing hole may be formed on an outer circumferential surface of the rotational shaft, or an inner circumferential surface of the shaft accommodating portion corresponding thereto.

The oil separator may be formed as an oil separation plate provided at the upper space of the casing and configured to divide the upper space into two parts in an axial direction. The oil separation plate may be provided with a plurality of through holes for communication between upper and lower sides of the oil separation plate with each other. One of the through holes may communicate with the oil guiding portion.

The drive motor may include a stator fixed to an inner circumferential surface of the casing, and a rotor rotatably provided in the stator with an air gap which forms a first passage. A plurality of cut-out surfaces may be formed on an outer circumferential surface of the stator in a circumferential direction, such that a space which forms a second passage may be formed between the outer circumferential surface of the stator and the inner circumferential surface of the casing. A passage separator configured to separate the first and second passages from each other may be provided between the drive motor and the frame.

Embodiments disclosed herein provide a scroll compressor that may include a casing having an inner space divided into an oil storage space to contain oil, and a mixture space to contain a refrigerant and oil in a mixed state; a motor part or motor including a stator provided at or in the mixture space of the casing, and including a rotor rotatably provided in the stator with an air gap which forms a first passage; a compression part or device provided at one side of the motor part, and configured to compress a refrigerant by a drive force transmitted from the motor part; a rotational shaft configured to transmit the drive force of the motor part to the compression part by connecting the motor part and the compression part with each other; an oil separator configured to separate oil from a refrigerant at the mixture space; and an oil guiding portion or guide having one or a first end connected to the oil separator, and another or a second end that communicates with the oil storage space and configured to guide the oil separated by the oil separator to the oil storage space. The oil separator may be implemented as a container having a hermetic oil separation space and with which a refrigerant discharge pipe which penetrates the casing may communicate. The container may have an inlet that communicates the mixture space and the oil separation space with each other. A center line of the inlet may form an angle with a center line of the first passage.

Another end of the oil guiding portion may be connected to an inlet of an oil pump that pumps oil to an oil supply passage of the rotational shaft. Another end of the oil guiding portion may be connected to an oil supply passage of the rotational shaft, such that oil may be guided to the oil supply passage by a pressure difference between two ends of the oil guiding portion.

The scroll compressor may further include a passage separator provided between the motor part and the compression part, and configured to separate a refrigerant passage and an oil passage from each other.

The scroll compressor according to embodiments disclosed herein may have at least the following advantages.

First, as an upper space and a lower space of the casing are connected to each other by the oil collection pipe, oil separated from a refrigerant may be smoothly collected in the oil storage space. Second, as the oil separator is installed or provided between the motor part and the compression part, oil which moves to the lower space from the upper space of the casing may be prevented from being mixed with a refrigerant. This may allow oil separated from a refrigerant to be smoothly collected.

Further, by the oil collection unit for forcibly collecting oil separated at the upper space to the lower space using a rotational motion of the rotational shaft, oil separated at the upper space may be rapidly collected in the lower space. As the oil separator is installed or provided at the upper space, oil may be effectively separated from a refrigerant at the upper space, and an amount of oil to be discharge may be reduced. This may enhance efficiency of the scroll compressor.

In the embodiments, the lower compression type scroll compressor was explained as an example. However, in some cases, embodiments may be also applicable to any compressor having a compression part at a lower region of a casing, for example, a rotary compressor.

Further scope of applicability will become more apparent from the detailed description given. However, it should be understood that the detailed description and specific examples, while indicating embodiments, are given by way of illustration only, since various changes and modifications within the spirit and scope will become apparent to those skilled in the art from the detailed description.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing that contains oil in a lower space thereof, the casing including a suction pipe through which a refrigerant is suctioned into the casing and a discharge pipe through which the refrigerant is discharged;

a drive motor provided at a position spaced from an upper end of the casing by a predetermined gap, such that an upper space is formed in the casing;

a rotational shaft coupled to a rotor of the drive motor, and having an oil supply passage to guide the oil contained in the casing;

a frame provided below the drive motor;

a fixed scroll provided below the frame, and having a fixed wrap;

an orbiting scroll provided between the frame and the fixed scroll, having an orbiting wrap so as to form a compression chamber by being engaged with the fixed wrap in which the refrigerant is compressed, and having an opening to receive the rotational shaft to the orbiting scroll in a penetrating manner; and an oil collection unit including an oil separator provided at the upper space of the casing and configured to separate oil from the refrigerant, and including an oil guide configured to guide the oil separated by the oil separator to the lower space of the casing, wherein the oil separator includes:

an oil separation container disposed in the upper space of the casing above and separated from the drive motor, the oil separation container having a predetermined oil separation space, wherein one end of the oil guide communicates with the oil separator container; and a communication pipe provided at one lateral side of the oil separation container, wherein the communication pipe is configured to provide communication between the oil separation space and the upper space, and wherein the oil guide includes an oil collection pipe and an oil pump having an inlet, wherein the oil collection pipe is configured to convey oil separated from the oil separation container, and wherein a first end of the oil collection pipe is connected directly to the oil separation container and a second end of the oil collection pipe is connected directly to the inlet of the oil pump, such that the oil separation container and the oil pump are connected through the oil collection pipe.

2. The scroll compressor of claim 1, wherein a lengthwise center line of the communication pipe forms a predetermined angle with the rotational shaft in an axial direction.

3. The scroll compressor of claim 1, wherein one end of a refrigerant discharge pipe that penetrates the casing communicates with the oil separation container, and wherein a lengthwise center line of the refrigerant discharge pipe forms a predetermined angle with a lengthwise center line of the communication pipe.

4. The scroll compressor of claim 1, wherein the inlet of the oil pump has a lower pressure than an inner pressure of the oil separation container.

5. The scroll compressor of claim 1, wherein the drive motor includes a stator fixed to an inner circumferential surface of the casing, and a rotor rotatably provided in the stator with an air gap therebetween which forms a first passage, wherein a plurality of cut-out surfaces is formed on an outer circumferential surface of the stator in a circumferential direction, such that a space which forms a second passage is formed between the outer circumferential surface of the stator and the inner circumferential surface of the casing, and wherein a passage separator including a wall configured to separate the first and second passages from each other is provided between the drive motor and the frame.

6. A scroll compressor, comprising:

a casing having an inner space divided into an oil storage space that contains oil, and a mixture space that contains a refrigerant and oil in a mixed state, the casing including a suction pipe through which the refrigerant is suctioned into the casing and a discharge pipe through which the refrigerant is discharged;

a motor including a stator provided in the mixture space of the casing, including a rotor rotatably provided in the stator with an air gap defined therebetween which forms a first passage;

a compression device provided below the motor, and configured to compress the refrigerant by a drive force transmitted from the motor;

a rotational shaft configured to transmit the drive force of the motor to the compression device by connecting the motor and the compression device with each other;

an oil separator configured to separate oil from refrigerant at the mixture space; and an oil guide having a first end connected to the oil separator, and a second end that communicates with the oil storage space and configured to guide the oil separated by the oil separator to the oil storage space, wherein the oil separator includes:

an oil separation container disposed in the mixture space above and separated from the motor, the oil separation container having a predetermined oil separation space, wherein one end of the oil guide communicates with the oil separator container; and a communication pipe provided at one lateral side of the oil separation container, wherein the communication pipe is configured to provide communication between the oil separation space and the mixture space, wherein the oil guide includes an oil collection pipe having a first end connected directly to the oil separation container, wherein one end of a refrigerant discharge pipe that penetrates the casing communicates with an upper surface of the oil separation container, wherein the scroll compressor further includes a passage separator including a wall provided between the motor and the compression device, wherein the passage separator is configured to separate a refrigerant passage and an oil passage from each other, wherein a lengthwise center line of a horizontally-extending end of the communication pipe forms a predetermined angle with the rotational shaft in an axial direction, wherein a lengthwise center line of the refrigerant discharge pipe forms a predetermined angle with the lengthwise center line of the horizontally-extending end of the communication pipe, and wherein the lengthwise center line at the horizontally extending end of the communication pipe forms a predetermined angle in a horizontally-extending plane with a virtual line that extends normal to a center axis of the oil separation container.

7. The scroll compressor of claim 6, wherein the oil separation container has an inlet that provides communication between the mixture space and the oil separation space, and wherein a center line of the inlet forms an angle with a center line of the first passage.

8. The scroll compressor of claim 6, wherein the second end of the oil guide is connected to an inlet of an oil pump that pumps oil to an oil supply passage of the rotational shaft.

9. The scroll compressor of claim 6, wherein the second end of the oil guide is connected to an oil supply passage of the rotational shaft, such that oil is guided to an oil supply passage by a pressure difference between the first and second ends of the oil guide.

10. A scroll compressor, comprising:

a casing having an inner space, the casing including a suction pipe through which a refrigerant is suctioned into the casing and a discharge pipe through which the refrigerant is discharged;

a motor provided in the inner space, having a stator coupled to the casing, a rotor rotatably provided in the stator, and an oil collection passage between an outer circumferential surface of the stator and an inner circumferential surface of the casing;

a compression device provided below the motor, and having a discharge opening through which the refrigerant compressed therein is discharged to the inner space of the casing;

a rotational shaft configured to transmit a drive force to the compression device from the motor; and an oil guide configured to forcibly collect oil separated at an upper space of the motor, using the rotational shaft, wherein an oil separator is provided at the upper space of the motor, wherein the oil separator is configured to separate oil from a refrigerant which moves to the upper space and to forcibly collect the separated oil by the oil guide, wherein the oil separator includes:

an oil separation container disposed in the inner space above and separated from the motor, the oil separation container having a predetermined oil separation space, wherein one end of the oil guide communicates with the oil separator container; and a communication pipe provided at one lateral side of the oil separation container, wherein the communication pipe is configured to provide communication between the oil separation space and the upper space, wherein the oil guide includes an oil collection pipe having a first end connected directly to the oil separation container, wherein one end of a refrigerant discharge pipe that penetrates the casing communicates with an upper surface of the oil separation container, wherein an oil pump is provided at the compression device, such that oil collected by the oil guide is guided to an oil supply passage formed in the rotational shaft, wherein the first end of the oil collection pipe is connected directly to the oil separation container and a second end of the oil collection pipe is connected directly to an inlet of the oil pump, wherein a lengthwise center line of a horizontally-extending end of the communication pipe forms a predetermined angle with the rotational shaft in an axial direction, wherein a lengthwise center line of the refrigerant discharge pipe forms a predetermined angle in a horizontally-extending plane with the lengthwise center line of the horizontally-extending end of the communication pipe, and wherein the lengthwise center line at the horizontally-extending end of the communication pipe forms a predetermined angle in a horizontally-extending plane with a virtual line that extends normal to a center axis of the oil separation container.

11. The scroll compressor of claim 10, wherein an outlet of the oil guide is connected to a region having a lower pressure than the oil separator, such that oil collected by the oil guide is guided to an oil supply passage formed in the rotational shaft.

12. The scroll compressor of claim 10, wherein oil collection pipe extends between the upper space and an oil storage space.

13. The scroll compressor of claim 12, wherein the oil collection pipe extends between the oil separator and the oil storage space.

14. The scroll compressor of claim 12, further comprising an oil separation plate provided in the upper space, wherein the oil collection pipe extends between the oil separation plate and the oil storage space.

* * * * *